United States Patent [19]

Schneider

[11] 3,989,053

[45] Nov. 2, 1976

[54] COMPACT HAIR PICK

[76] Inventor: Paul W. Schneider, 37 Coolidge Road, Danvers, Mass. 01923

[22] Filed: Jan. 27, 1976

[21] Appl. No.: 652,779

[52] U.S. Cl. ..... 132/11 R
[51] Int. Cl.[2] ..... A45D 1/00
[58] Field of Search ..... 132/11 R, 9, 101, 123, 132/143, 150, 155, 158, 160, 103

[56] References Cited

UNITED STATES PATENTS

| | | | |
|---|---|---|---|
| 2,297,714 | 10/1942 | Nesbitt | 132/9 |
| 3,424,174 | 1/1969 | Battaglia | 132/11 R |
| 3,814,112 | 6/1974 | Tupper | 132/11 R |

*Primary Examiner*—G.E. McNeill
*Attorney, Agent, or Firm*—Joseph S. Iandiorio

[57] ABSTRACT

A compact hair pick including a handle frame; a pick assembly including a mounting bar rotatably mounted to the handle frame for rotation about a first axis; and a plurality of tines extending from the mounting bar transversely to its axis of rotation, the pick assembly and cover being rotatable as a unit from a first position in which the tines and cover extend toward and are within the handle frame, to a second position in which the tines and cover extend away from and are external to the handle frame; and a cover rotatably mounted to the mounting bar for rotation about a second axis transverse to the first axis from a first position covering the tines and outside the handle frame, to a second position exposing the tines and covering at least a portion of the handle frame and mounting bar.

3 Claims, 7 Drawing Figures

24
32
26
16
22
28
30
18
20
12
10
14
38
34
36
40
42
44

COMPACT HAIR PICK

FIELD OF INVENTION

This invention relates to a rotatably retractable, compact hair pick.

BACKGROUND OF INVENTION

Hair picks, especially those known as "Afro" hair picks, include a number of long thin tines or teeth which can be easily snagged and broken when carried in purse or pocket. In order to provide some measure of protection for the tines and to prevent snagging, some hair picks have been made retractable. Retractability also enhances the compactness of the hair pick. Typically a retractable structure includes a cover in which the pick assembly is slidable by means of tracks or guides, and includes an actuator of some sort and a slot in the cover for accessing the actuator. The result is a relatively complicated and expensive mechanism.

SUMMARY OF INVENTION

It is therefore an object of this invention to provide an improved simple, inexpensive and compact retractable hair pick.

It is a further object of this invention to provide such a hair pick in which the retraction is accomplished by mutual rotation of the parts.

The invention results from the realization that a much simpler and inexpensive lockable, compact retractable hair pick could be made by making the handle frame, pick assembly and cover relatively rotatable about two transverse axes.

The invention features a compact hair pick having a handle frame and a pick assembly, including a mounting bar rotatably mounted to the handle frame for rotation about a first axis, and a plurality of tines extending from the mounting bar transversely to its axis of rotation. Starting from the compact position, the pick assembly and cover are rotatable as a unit about the first axis from a first position in which the tines and cover extend toward and are within the handle frame, to a second position in which the tines and cover extend away from and are external to the handle frame. The cover is rotatably mounted to the mounting bar for rotation about a second axis transverse to the first axis, from a first position covering the tines and outside the handle frame, to a second position exposing the tines and covering at least a portion of the handle frame and mounting bar to lock the pick assembly against further rotation about the first axis. Preferably the first and second axes are eccentric to each other, in order that the cover clear the tines and the handle frame when rotated about the second axis to permit the cover to fit within the handle frame when rotated about the first axis.

DISCLOSURE OF PREFERRED EMBODIMENT

Other objects, features and advantages will occur from the following description of a preferred embodimemt and the accompanying drawings, in which.

Figures 1, 2, 3, 4, 5, 6, 7:
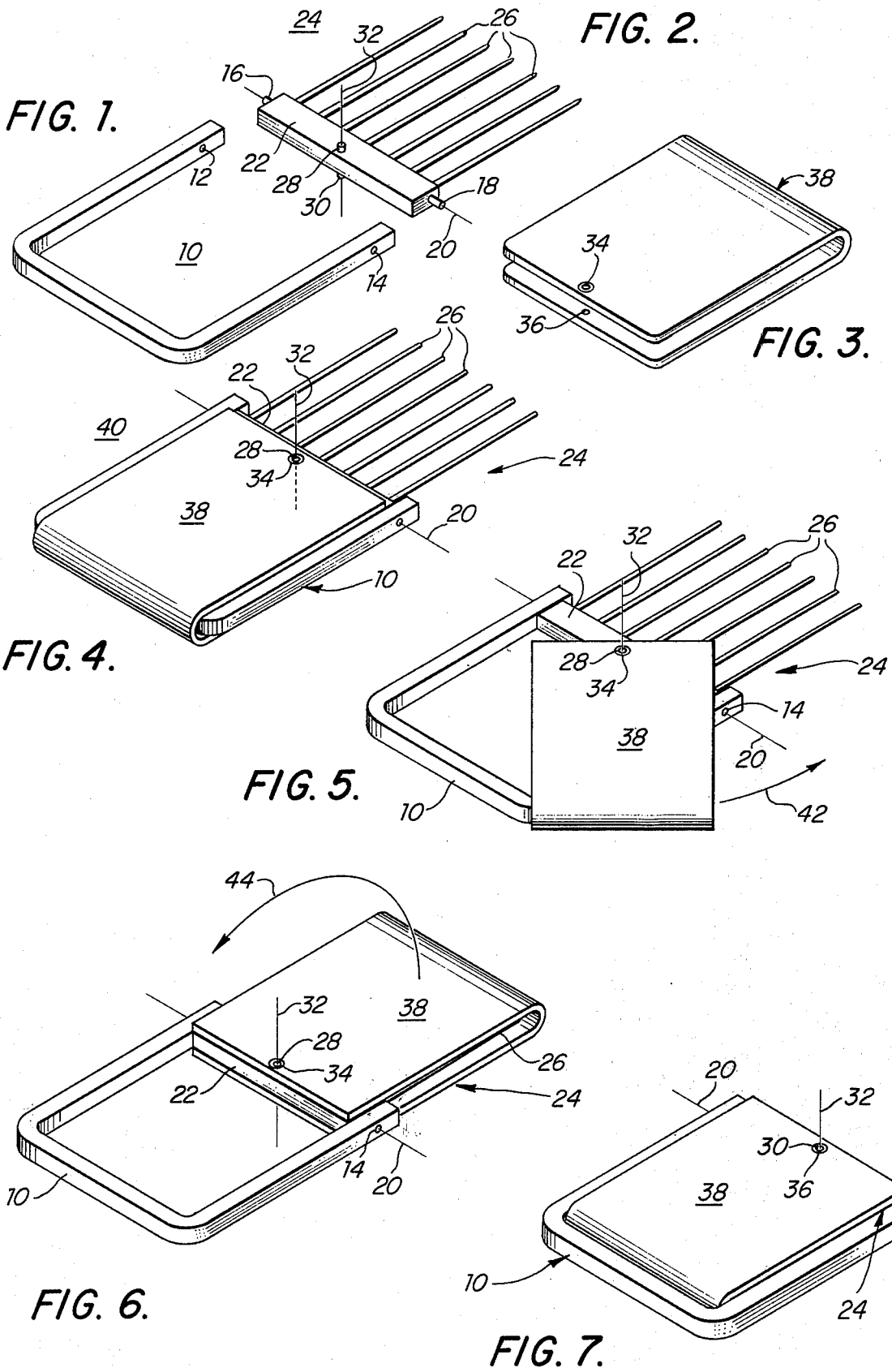
FIG. 1 is an axonometric view of a handle frame of the hair pick of this invention.
FIG. 2 is an axonometric view of a pick assembly of the hair pick of this invention.
FIG. 3 is an axonometric view of a cover of a hair pick of this invention.
FIG. 4 is an axonometric view of the pick of FIG. 6, with the cover locking the pick assembly in the fully extended position.
FIG. 5 is an axonometric view of the pick of FIG. 4 with the cover partially rotated, thereby partially covering the tines and beginning to unlock the pick assembly relative to the handle.
FIG. 6 is a view of the hair pick in FIG. 5, with the cover fully unlocked from the handle frame and rotated to cover the tines.
FIG. 7 is an axonometric view of the hair pick of this invention in the fully retracted state, ready for storage in pocket or purse.

There is shown in FIG. 1 a handle frame 10, which includes a pair of holes 12 and 14. Holes 12 and 14 receive pins 16 and 18 respectively, FIG. 2, which extend along a first axis 20 from tine mounting bar 22 of pick assembly 24, which also includes tines 26. Pins 28 and 30 extend from bar 22 along a second axis 32, which is transverse to and eccentric of axis 20. Pins 28 and 30 engage with holes 34 and 36 respectively in cover 38, FIG. 3.

Cover 38, handle frame 10, and pick assembly 24 are assembled as shown in FIG. 4, to form the compact, retractable hair pick 40 according to this invention. In FIG. 4, tines 26 are extended and cover 38 is in a locking position to prevent rotation of tines 26 and bar 22 about axis 20 on pins 16 and 18, FIG. 2. Pick assembly 24 is secure against unwanted movement by the location of cover 38, which partially surrounds a portion of handle frame 10.

To retract tines 26 of pick assembly 24, cover 38 is first rotated about axis 32 in a direction shown by arrow 42, FIG. 5, so that cover 38 clears handle 10 and moves toward a position covering tines 26.

Continued rotation of cover 38 in this direction results in cover 38 assuming the position shown in FIG. 6, in which it has completely cleared handle frame 10, and now completely covers tines 26 and bar 22 of pick assembly 24.

To complete the retraction operation, rotation of the combination of cover 38 and pick assembly 24 is now begun about axis 20 by rotating cover 38 and pick assembly 24, rotatable on pins 16 and 18 in holes 12 and 14 in handle 10, in the direction indicated by arrow 44, FIG. 6. Finally, when this rotation is complete about axis 20, cover 38 resides within handle 10 as shown in FIG. 7 with pick assembly 24 completely received within cover 38.

Other embodiments will occur to those skilled in the art and are within the following claims:

What is claimed is:

1. A compact hair pick comprising:

a handle frame;

a pick assembly including a mounting bar rotatably mounted to said handle frame for rotation about a first axis and a plurality of tines extending from said mounting bar transversely to its axis of rotation, said pick assembly and cover being rotatable as a unit from a first position in which said tines and cover extend toward and are within said handle frame to a second position in which said tines and cover extend away from and are external to said handle frame; and a cover rotatably mounted to said mounting bar for rotation about a second axis transverse to said first axis from a first position covering said tines and outside said handle frame to a second position exposing said tines and covering at least a portion of said handle frame and mounting bar.

2. The compact hair pick of claim 1 in which said first and second axes are eccentric to each other.

3. The compact hair pick of claim 1 in which said cover lockably engages said handle frame in said second position to prevent further rotation of said pick assembly about said first axis.

* * * * *